US011536258B2

(12) United States Patent
Lee et al.

(10) Patent No.: US 11,536,258 B2
(45) Date of Patent: Dec. 27, 2022

(54) COMPRESSOR INCLUDING CYLINDER BLOCK CORRESPONDING TO OUTER ROTOR TYPE MOTOR

(71) Applicant: LG Electronics Inc., Seoul (KR)

(72) Inventors: Kiyeon Lee, Seoul (KR); Jinkook Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 548 days.

(21) Appl. No.: 16/660,088

(22) Filed: Oct. 22, 2019

(65) Prior Publication Data

US 2020/0124037 A1 Apr. 23, 2020

(30) Foreign Application Priority Data

Oct. 22, 2018 (KR) ..... 10-2018-0125953

(51) Int. Cl.

| | |
|---|---|
| ***F04B 39/00*** | (2006.01) |
| ***F04B 1/20*** | (2020.01) |
| ***F04B 39/12*** | (2006.01) |

(52) U.S. Cl.

CPC ..... *F04B 39/0033* (2013.01); *F04B 1/20* (2013.01); *F04B 39/0061* (2013.01); *F04B 39/122* (2013.01)

(58) Field of Classification Search

CPC ..... F04B 39/033; F04B 39/0061; F04B 39/0088; F04B 39/122

See application file for complete search history.

(56) References Cited

U.S. PATENT DOCUMENTS

| | | | | |
|---|---|---|---|---|
| 2005/0089416 | A1* | 4/2005 | Lee | F04B 39/122 417/415 |
| 2016/0131125 | A1 | 5/2016 | Yang et al. | |
| 2017/0009755 | A1 | 1/2017 | Yanase | |

FOREIGN PATENT DOCUMENTS

| | | |
|---|---|---|
| CN | 106030105 | 10/2016 |
| CN | 107795459 | 3/2018 |
| CN | 108266350 | 7/2018 |
| JP | 10299681 | 11/1998 |
| JP | 2012036847 | 2/2012 |
| JP | 2014521868 | 8/2014 |
| JP | 6143314 | 6/2017 |
| JP | 2017145787 | 8/2017 |

(Continued)

OTHER PUBLICATIONS

Akashi, "WO2018216654_MT_JP.pdf" (Machine Translation), 2018 (Year: 2018).*

(Continued)

*Primary Examiner* — Kenneth J Hansen

(74) *Attorney, Agent, or Firm* — Fish & Richardson P.C.

(57) ABSTRACT

A cylinder block for a compressor includes: a shaft support configured to support a rotary shaft of an outer rotor type motor; a first support that is arranged radially outward of the shaft support and that extends along a circumferential direction about a center of the shaft support; a second support that is arranged radially outward of the first support and that extends along the circumferential direction about the center of the shaft support; a third support that connects the first support to the second support; a cylinder portion that defines a cylindrical inner space at a position radially away from the center of the shaft support; and a noise chamber defined at at least one side of the cylinder portion.

19 Claims, 14 Drawing Sheets

(56) References Cited

FOREIGN PATENT DOCUMENTS

| | | | | |
|---|---|---|---|---|
| KR | 2019990014945 | | 5/1999 | |
| KR | 1020070058903 | | 6/2007 | |
| KR | 1020170104195 | | 9/2017 | |
| WO | WO2012034944 | | 3/2012 | |
| WO | WO-2013016795 | A1 * | 2/2013 | ..... F04B 39/0055 |
| WO | WO2015028075 | | 3/2015 | |

OTHER PUBLICATIONS

Extended European Search Report in European Application No. 19204569.8, dated Feb. 3, 2020, 6 pages.
Korean Notice of Allowance in Korean Application No. 10-2018-0125953, dated May 27, 2020, 2 pages (with English translation).
CN Office Action in Chinese Appln. No. 201911004940.7, dated May 7, 2021, 15 pages (with English translation).

* cited by examiner

COMPRESSOR INCLUDING CYLINDER BLOCK CORRESPONDING TO OUTER ROTOR TYPE MOTOR

CROSS-REFERENCE TO RELATED APPLICATIONS

This application claims the benefit of priority to Korean Application No. 10-2018-0125953, filed on Oct. 22, 2018, which is hereby incorporated by reference as if fully set forth herein.

TECHNICAL FIELD

The present disclosure relates to a compressor, and more particularly, to a compressor including a cylinder block corresponding to an outer rotor type motor.

BACKGROUND

A reciprocating compressor is an apparatus that may suction, compress, and discharge fluid based on a reciprocating movement of a piston within a cylinder.

In some examples, the reciprocating compressor may include reciprocating elements such as a piston, a connecting rod, and a crank pin, and elements for converting rotational force of a motor to a reciprocating movement of the piston. In some cases, an eccentric portion may be provided in a rotary shaft. The reciprocating elements or the elements for converting the rotational force to the reciprocating movement may be provided on a cylinder block.

The cylinder block may support a movement portion of the compressor while providing a compression space.

When the compressor is driven, the piston, the connecting rod, the crank pin, the eccentric portion, etc. may generate an excitation force in the compressor.

In some cases, a moment may be generated by the excitation force, and act in a vertical direction. The moment may partially be improved through a vibration transfer system such as a support that includes a spring, and may act toward a movement direction of the piston.

SUMMARY

The present disclosure describes a compressor including an outer rotor type motor and a cylinder block corresponding to the outer rotor type motor.

The present disclosure also describes a compressor including an outer rotor type motor and a cylinder block capable of improving vibration by reinforcing an inertia moment.

The present disclosure also describes a compressor including an outer rotor type motor and a cylinder block capable of reinforcing rigidity while having a light weight.

The present disclosure also describes a compressor including an outer rotor type motor and a cylinder block capable of improving heat radiation characteristics.

In some examples, a compressor including an outer rotor type motor may rotate a rotary shaft with a radius wider than a compressor including an inner rotor type motor. In some cases, the compressor including the outer rotor type motor may apply a great excitation force in a mechanical portion, for example, during start and stop for a rapid speed change, where improved mechanical design may be required to increase rotation inertia of the mechanical portion of the compressor.

The cylinder block structure described in this application may reinforce rotation inertia by outwardly distributing a mass of a cylinder block of a compressor and minimizing a center mass.

In some implementations, the present disclosure may improve motor performance by radiating heat of a stator fixed to a rotary shaft portion through oil by minimizing a center mass of a cylinder block and forming an oil hole near a rotary shaft.

In some implementations, the oil hole may be formed using a plurality of supports connected with a shaft support.

According to one aspect of the subject matter described in this application, a cylinder block for a compressor, which includes an outer rotor type motor and a rotary shaft coupled to the outer rotor type motor, includes: a shaft support configured to support the rotary shaft; a first support that is arranged radially outward of the shaft support and that extends along a circumferential direction about a center of the shaft support; a second support that is arranged radially outward of the first support and that extends along the circumferential direction about the center of the shaft support; a third support that connects the first support to the second support; a cylinder portion that defines a cylindrical inner space at a position radially away from the center of the shaft support; and a noise chamber defined at at least one side of the cylinder portion.

Implementations according to this aspect may include one or more of the following features. For example, the cylinder block may define a first hole between the shaft support and the first support. In some examples, the cylinder block may further define a second hole between the first support and the second support. In some examples, the third support may extend along a radius direction with respect to the center of the shaft support. The noise chamber may be defined at both sides of the cylinder portion.

In some implementations, the cylinder portion may include: a main block that defines an inner side of the cylindrical inner space; and an inlet portion connected to the main block, where the cylindrical inner space extends from the main block to the inlet portion toward the shaft support. In some examples, the inlet portion may define an oil inlet groove having an open side.

In some implementations, the cylinder block may further include a stopper that protrudes from the second support and that is configured to limit contact between parts of the cylinder block and a casing of the compressor in response to external impact. In some examples, the stopper may be connected to the third support. In some examples, the first support connects between the noise chamber and the third support.

According to another aspect, a compressor includes: a casing that defines a sealed inside space therein; a cylinder block located in the sealed inside space; a motor disposed in the sealed inside space at a position vertically below the cylinder block, the motor being an outer rotor type motor; a rotary shaft coupled to the cylinder block, the rotary shaft comprising an eccentric portion that is disposed at a position offset from a center of the rotary shaft and that is configured to be rotated by a rotational force of the motor; and a piston connected to the rotary shaft and configured to reciprocate within the cylinder block based on rotation of the eccentric portion. The cylinder block includes: a shaft support coupled to the rotary shaft and configured to support the rotary shaft; a first support that is arranged radially outward of the shaft support and that extends along a circumferential direction about a center of the shaft support; a second support that is arranged radially outward of the first support and that extends along the circumferential direction about the center of the shaft support; a third support that connects the first support to the second support; a cylinder portion that defines a cylindrical inner space configured to receive the piston; and a noise chamber defined at at least one side of the cylinder portion.

Implementations according to this aspect may include one or more of the following features or the features described above. For example, the cylinder block may define a first hole between the shaft support and the first support. In some examples, the cylinder block may further define a second hole between the first support and the second support. In some examples, the third support may extend along a radius direction with respect to the center of the shaft support. The noise chamber may be defined at both sides of the cylinder portion.

In some implementations, the cylinder portion may include: a main block that defines an inner side of the cylindrical inner space; and an inlet portion connected to the main block, where the cylindrical inner space extends from the main block to the inlet portion toward the shaft support. In some examples, the inlet portion may define an oil inlet groove having an open side.

In some implementations, the compressor may further include a stopper that protrudes from the second support and that is configured to limit parts of the cylinder block and the casing in response to external impact. In some examples, the stopper may be connected to the third support. In some examples, the first support may connect between the noise chamber and the third support.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate implementation(s) of the present application and together with the description serve to explain the principle of the disclosure.

DETAILED DESCRIPTION

Hereinafter, the implementation according to the present disclosure will be described in detail with reference to the accompanying drawings.

While various corrections and modifications can be made in the present disclosure, specific implementations of the present disclosure will be disclosed by drawings, which are illustrated, and will be described in detail hereinafter. However, it is to be understood that the specific implementations are not intended to limit the present disclosure in a specific form which is disclosed, and the present disclosure includes all modifications, equivalents or replacements included in technical spirits of the present disclosure, which are defined by claims.

Figure 1:
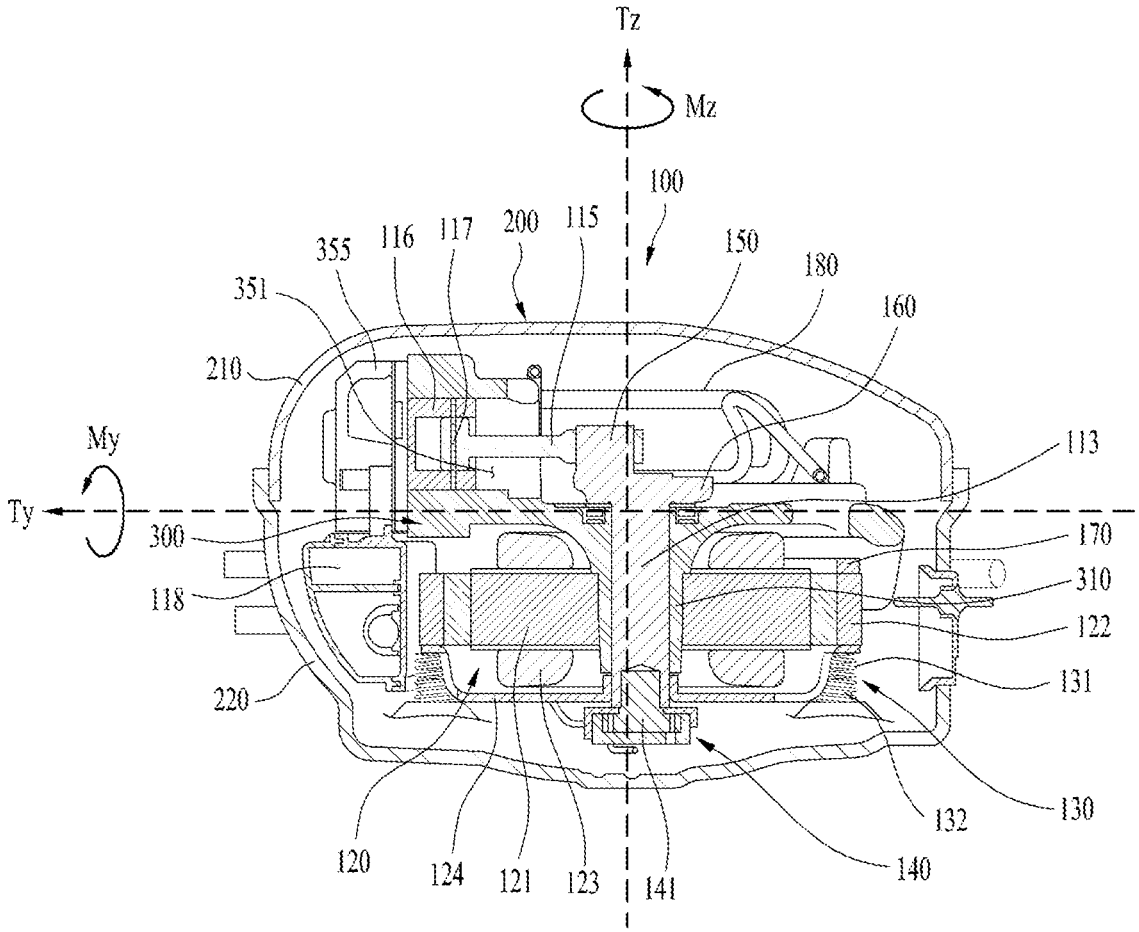
FIG. 1 is a sectional view illustrating an example of a compressor.

FIG. 1 is a sectional view illustrating an example of a compressor.

Referring to FIG. 1, the compressor 100 may include a casing 200 defining a sealed inside space therein, and a cylinder block 300 received in the inner space of the casing 200, where the cylinder block 300 defines an inner space 351 having a cylindrical shape.

The casing 200 may include an upper shell 210 and a lower shell 220 which are coupled with each other. The upper shell 210 and the lower shell 220 may be coupled to be sealed with each other.

In this structure of the compressor 100, the casing 200 has an outer structure making a refrigerant atmosphere by sealing the inside of the compressor 100 and blocking contact of the external air.

The cylinder block 300 may include a shaft support 310 by which a rotary shaft 113 (e.g., a crank shaft) is supported. The cylinder block 300 will be described later in detail.

The rotary shaft 113 may rotatably be located in the shaft support 310. An eccentric portion 150 may be located above the rotary shaft 113 to switch a rotary movement to a reciprocating movement. The eccentric portion 150 may be located at a position offset from a center of the rotary shaft 113 such that the eccentric portion 150 may rotate about the center of the rotary shaft 113.

In some examples, a piston 116 may be connected to the eccentric portion 150 by a connecting rod 115, and may reciprocate within a cylindrical inner space 351. The piston 116 and the connecting rod 115 may be coupled with each other by a piston pin 117.

A motor 120 for transferring a rotational force to the rotary shaft 113 may be provide below the cylinder block 110.

The motor 120 may include a stator 121 provided near the shaft support 112 and a rotor 122 disposed outside the stator 121 and configured to rotate relative to the stator 121. That is, the motor 120 may have an outer rotor structure. The motor having an outer rotor type structure may be referred to as an outer rotor type motor.

A coil 123 may be wound in the stator 121 of the motor 120 to generate a magnetic force. The rotor 122 may be rotated by an electromagnetic force generated by the stator 121 and the coil 123.

A rotor frame 124 for transferring the rotational force of the motor 120 to the rotary shaft 113 may be provided below the motor 120.

The rotor frame 124 may be an element required to transfer the rotational force of the motor 120 to the rotary shaft 113 when the outer rotor type motor 120 is used.

In some implementations, an oil supply 140 for supplying oil to the cylinder 111 may be provided below the rotary shaft 113. The oil supply 140 may include an oil pump 141.

A support 130 for supporting a structure body constituting the compressor 100 may be included in the casing 200. That is, the support 130 may support the structure body constituting the compressor 100 with respect to the casing 200.

In some examples, the support 130 may include a buffer member 131 such as spring, and may further include a damper 132 for restricting vibration of the buffer member 131.

In some implementations, a pipe 180 connected to the cylinder 111 to discharge a compressed refrigerant therethrough may further be provided.

Also, a suction muffler 118 located in a path for sucking a low pressure refrigerant into the cylinder 111 and designed in consideration of sound transfer characteristics to attenuate noise may be provided.

When the compressor 100 constructed as above is driven, an unbalanced moment may be generated by a reciprocating movement. The unbalanced moment may be generated even by rotation of the eccentric portion 150 connected to the rotary shaft 113.

The unbalanced force may cause vibration and noise caused by vibration when the compressor 100 is driven.

Therefore, elements having a mass (or weight) for counterbalancing the unbalanced force may be provided in the compressor 100.

An example of the element for counterbalancing the unbalanced force may include a counter weight 160 formed at an end portion of the rotary shaft 113 and an opposing side of the eccentric portion 150.

Also, an example of the element for counterbalancing the unbalanced portion may include a balance weight 170 provided at an upper side or a lower side of the rotor 122.

As described above, the cylinder block 300 may include a cylindrical inner space 351 that can compress a fluid such as a refrigerant through reciprocating movement of the piston 116. The cylinder block 300 may further include a shaft support 310 through which the rotary shaft 113 rotated to allow the piston 116 to reciprocate is supported.

In some examples, a cylinder cover 355 may be located outside the cylindrical inner space 351, and may include a space where the compressed fluid is temporarily collected, while covering the cylindrical inner space 351.

The cylinder block 300 serves to support a main movement portion of the compressor while providing a compression space. Therefore, as main design elements of the cylinder block 300, vibration attenuation, rigidity reinforcement and heat radiation may be considered.

The elements for vibration attenuation, rigidity reinforcement and heat radiation of the cylinder block 300 will be described in brief and then a structure of the cylinder block 300 will be described in detail.

The cylinder block 300 may enable vibration attenuation.

A main excitation force according a reciprocating movement of the piston 116 may include a torque Ty in a direction 'y' shown in FIG. 1 and a torque Tz in a direction 'z'. That is, when the compressor is operated, a torque may act on the direction 'y' corresponding to the movement direction of the piston 116 shown in FIG. 1 and a vertical direction with respect to the direction 'y'.

In some examples, a y-direction moment My may be generated by a y-direction torque Ty, and a z-direction moment Mz may be generated by a z-direction torque Tz.

The y-direction moment My may be improved by the aforementioned support 130. That is, the y-direction moment My may be counterbalanced through at least one of the buffer member 131 such as a spring and the damper 132.

In some examples, the z-direction moment Mz may be improved by reinforcing an inertia moment of the cylinder block 300 through a mass distribution of the cylinder block 300. To this end, the mass distribution of the cylinder block 300 may mainly be concentrated on the outside.

The cylinder block 300 may enable rigidity reinforcement

A design for removing some mass elements for light weight is basically applied to the cylinder block 300. Also, the mass distribution of the cylinder block 300 may mainly be concentrated on the outside for reinforcement of the aforementioned inertia moment, and due to this design, rigidity of the shaft support 310 in which the rotary shaft 113 is located may be deteriorated.

Therefore, in order to reinforce rigidity of the shaft support 310, various supports (a first support 320, a second support 330 and a third support 340) may be provided. Also, a thickness of a peripheral portion of the shaft support 310 may be reinforced.

The cylinder block 300 may enable heat radiation.

Two types of heat radiators that include heat radiation according to refrigerant compression in the cylinder and heat radiation of a motor portion according to resistance of a winding wire wound in the stator 11 of the motor exist in the compressor.

In some examples, oil in the compressor may serve as a heat radiation function for removing heat of the heat radiator as well as a lubricating function.

In the present disclosure, the stator 121 is located near the shaft support in the structure of the compressor in which the outer rotor type motor is adopted. Therefore, a hole (a first hole) may be formed on an upper end of the stator 121, whereby the oil may enter the winding wire of the stator 121.

Hereinafter, the structure of the cylinder block 300 will be described in detail with reference to the accompanying drawings.

Figure 2:
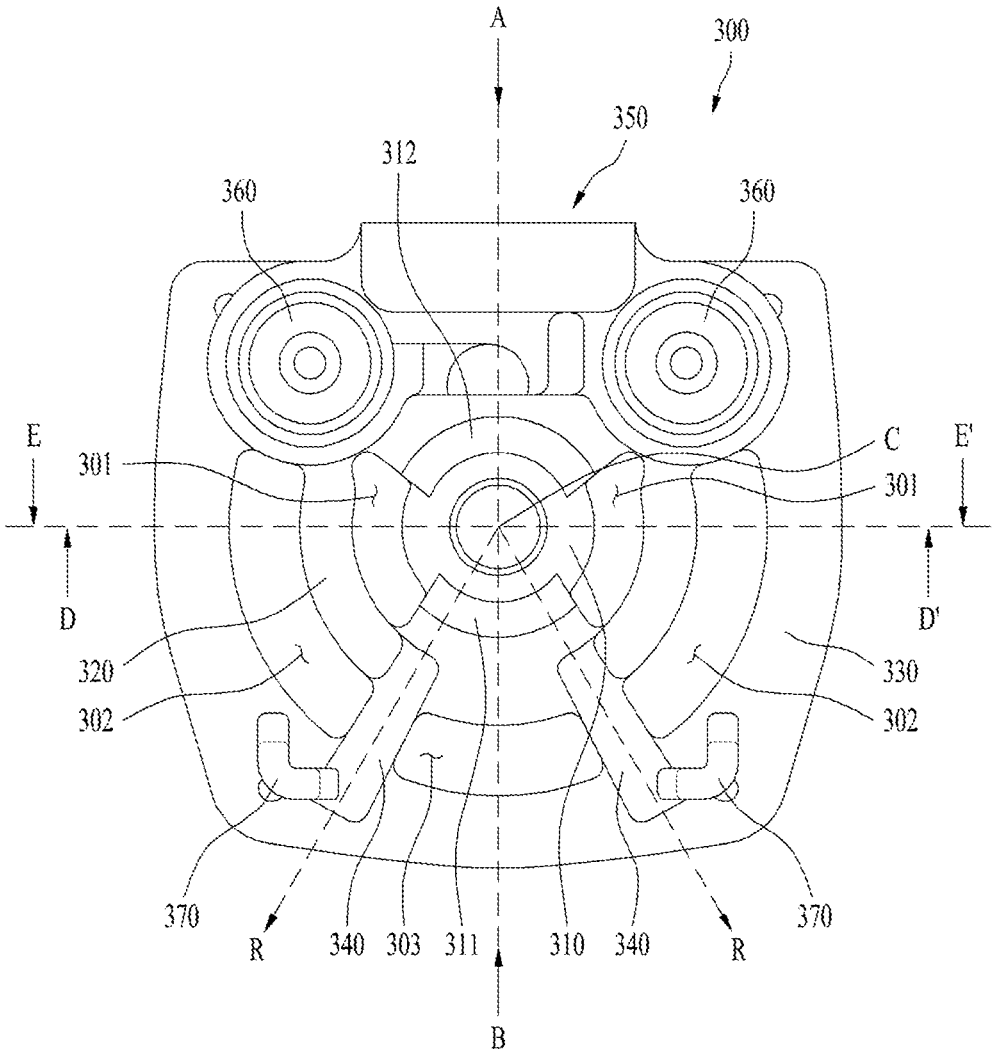
FIG. 2 is a plane view illustrating an example of a cylinder block.
Figure 3:
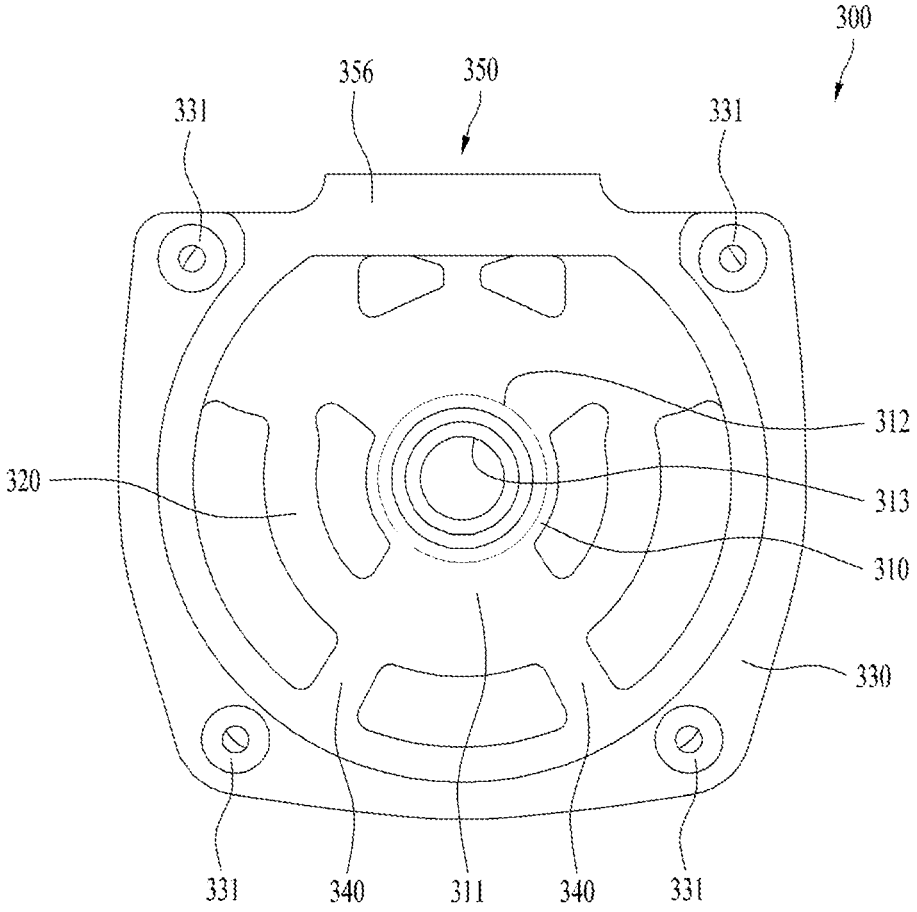
FIG. 3 is a bottom view illustrating an example of a cylinder block.

FIG. 2 is a plane view illustrating an example of a cylinder block, and FIG. 3 is a bottom view illustrating an example of a cylinder block.

Referring to FIG. 2, the cylinder block 300 may include a shaft support 310 for supporting the rotary shaft 113 of the compressor, a first support 320 arranged outside the shaft support 310, a second support 330 arranged outside the first support 320, a third support 340 for connecting the first support 320 with the second support 330, a cylinder portion 350 for forming a cylindrical inner space at a position far away from a center C of the shaft support 310 at a certain distance, and a noise chamber 360 located at one side of the cylinder portion 350.

The first support 320 may be arranged in a circumferential direction with respect to the center C of the shaft support 310. In some examples, the second support 330 may be arranged in a circumferential direction with respect to the center C of the shaft support 310.

The second support 330 may have a thickness and/or width greater than that of the first support 320. Since the elements of the cylinder block 300 are formed of the same material, the element having a thickness and/or width greater than that of the other element may have a greater mass. Therefore, the second support 330 may have a mass greater than that of the first support 320, and it is noted that the mass of the cylinder block 300 is more distributed in the outside than any other portion.

The third support 340 may be located at two places symmetrical to the movement direction (which refers to a direction of a line connecting A with B in FIG. 2) of the piston 116.

In some examples, the third support 340 may be arranged in a radius direction R with respect to the center C of the shaft support 310.

At least one of the first support 320, the second support 330 and the third support 340 may reinforce rigidity of the shaft support 310 as described above. When the first support 320, the second support 330 and the third support 340 act together, it is possible to reinforce rigidity of the shaft support 310 more effectively.

As shown, the noise chamber 360 may be located at both sides of the cylinder portion 350. These two noise chambers 360 may be located symmetrically to the cylinder portion 350.

The two noise chambers 360 may serve to buffer impact sound caused by compression twice. For example, the noise chambers 360 may protrude from a surface between the first support 320 and the second support 330 to thereby define a recess. The recess may have a cylindrical shape. In some cases, the noise chambers 360 may include a protrusion that extends from a bottom surface of the recess, where a top end of the protrusion may be located below a top end of the noise chamber 360.

In some implementations, the first hole 301 may be located between the shaft support 310 and the first support 320. Also, the second hole 302 may be located between the first support 320 and the second support 330.

In some examples, when two third supports 340 are provided, the third hole 303 may be located between these two third supports 340.

Since the first support 320 and the second support 330 are arranged in a circumferential direction with respect to the center C of the shaft support 310, each of the first hole 301, the second hole 302 and the third hole 303 may have an arc shape.

At least one of the first hole 301, the second hole 302 and the third hole 303 may improve heat radiation characteristics of the compressor. That is, as described above, oil may enter the winding wire of the stator 121 of the motor 120 by passing through at least one of the first hole 301, the second hole 302 and the third hole 303. Therefore, heat generated from the winding wire may be absorbed by oil.

The cylinder block 300 described as above may provide a structure that can attenuate vibration and improve heat radiation characteristic in the compressor 100 based on the motor 120 having an outer rotor structure.

In some implementations, a stopper 370 for protecting the inner elements of the compressor with respect to external impact may be formed on the second support 330 located at the outmost. As shown, the stopper 370 may be located at two places symmetrical to the movement direction (which refers to a direction of a line connecting A with B in FIG. 2) of the piston 116 in the same manner as the third support 340.

In some examples, the stopper 370 may connected with the third support 340.

Referring to FIG. 2, a first extension portion 311 may be located in a direction from the shaft support 310 to the third support 340. In some examples, a second extension portion 312 may be located in a direction from the shaft support 310 to the cylinder portion 350.

At least one of the first extension portion 311 and the second extension portion 312 may allow the shaft support 310 to be connected with a peripheral portion, thereby reinforcing rigidity of the shaft support 310.

Referring to FIG. 3, a groove 331 in which the support 130 is located may be formed on a lower surface of the cylinder block 300.

The cylinder block 300 may have a rectangular shape, approximately, and the groove 331 may be formed at each corner of the rectangular shape of the cylinder block 300.

In some implementations, the second support 330 may be located at a portion except the cylinder portion 350. That is, the second support 330 may not be formed at a lower portion 356 of the cylinder portion 350. The lower portion 356 of the cylinder portion 350 may form a space for coupling of the other components such as the suction muffler 118.

A repeated description of portions except the portions shown in FIG. 3 will be omitted. In the following drawings, the description of the repeated portions will be omitted and a description will be based on the portions that require the corresponding description.

Figure 4:
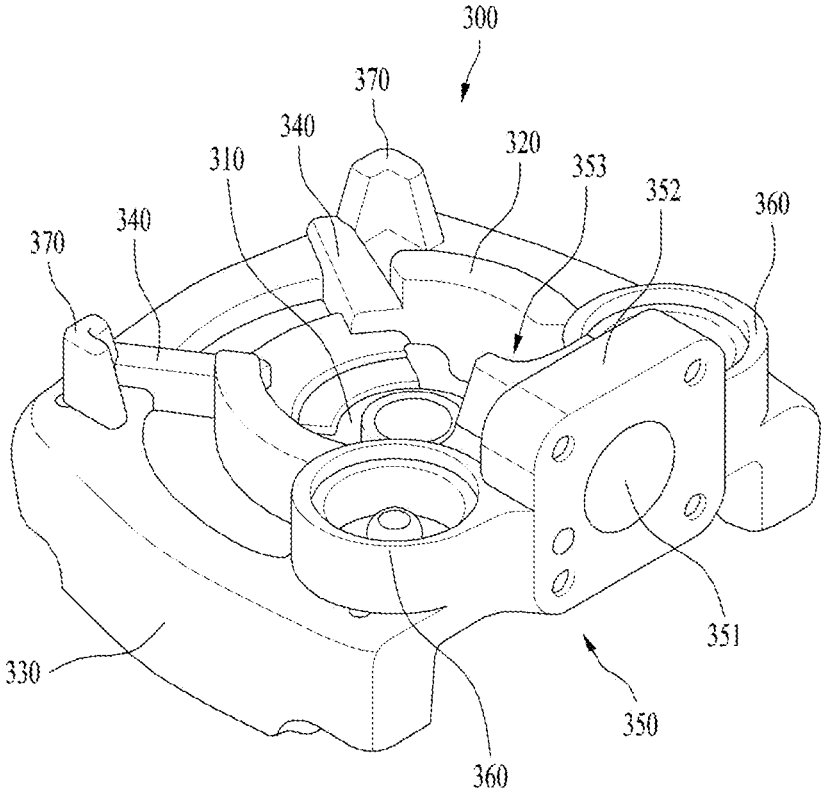
FIG. 4 is a perspective view illustrating an example of a cylinder block.
Figure 5:
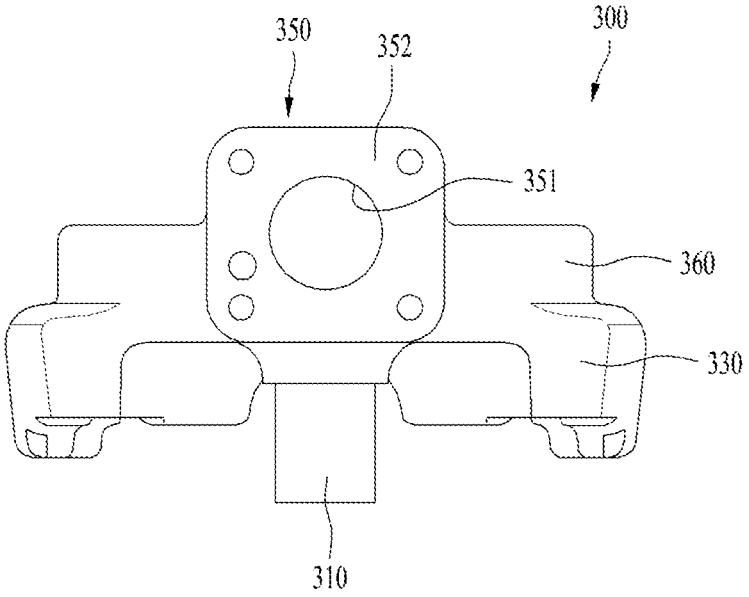
FIG. 5 is a view showing the cylinder block viewed in direction A of FIG. 2.
Figure 6:
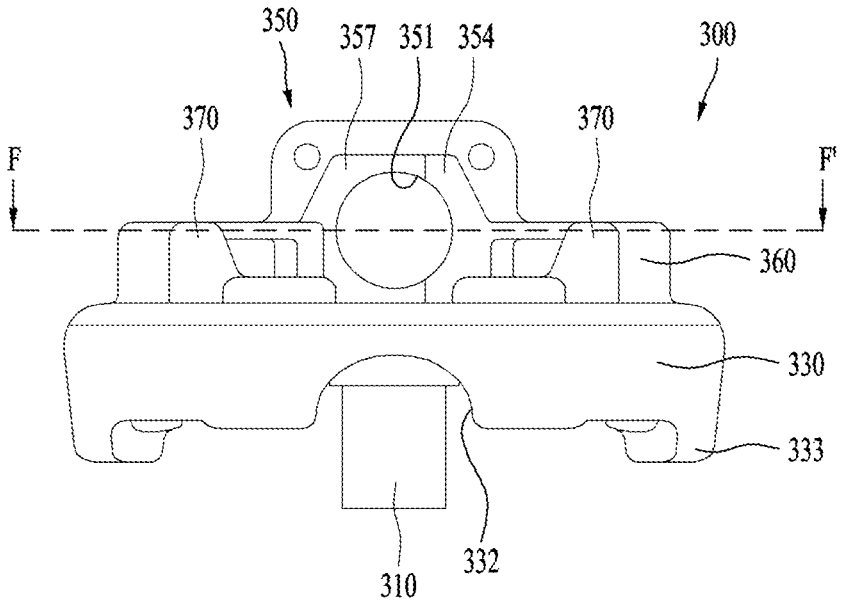
FIG. 6 is a view showing the cylinder block viewed in direction B of FIG. 2.
Figure 7:
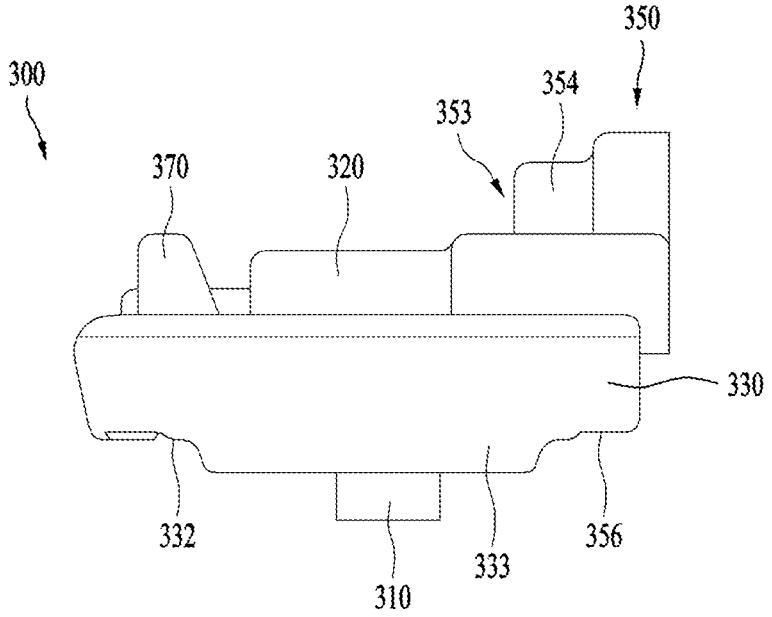
FIG. 7 is a side view illustrating an example of a cylinder block.

FIG. 4 is a perspective view illustrating an example of a cylinder block. FIG. 5 is a view viewed in a direction A of FIG. 2. FIG. 6 is a view viewed in a direction B of FIG. 2. FIG. 7 is a side view illustrating an example of a cylinder block.

The cylinder portion 350 will mainly be described with reference to FIGS. 4 to 7.

The cylinder portion 350 may include a main block 352 for forming a cylindrical inner space 351 at an inner side, and an inlet portion 353 connected to the main block 352 to allow the inner space 351 to be extended thereto.

Most of the cylindrical inner space 351 may be formed at the inner side of the main block 352.

The inlet portion 353 extended from the main block 352 may have an outer shape formed to be smaller than the main block 352.

The inlet portion 353 may have an oil inlet groove 357 (see FIG. 6) which is opened.

That is, the oil inlet groove 357 may have a shape dented along one side from a side closest to the shaft support 310.

That is, the oil inlet groove 357 may have an asymmetrical shape with respect to a reciprocating direction of the piston that reciprocates in the inner space 351.

In this way, the inlet portion 353 may be provided with a guide portion 354 formed at a side closest to the shaft support 310 to support the movement of the piston while guiding the movement of the piston, and may be provided with the oil inlet groove 357 formed to be extended from the guide portion 354.

The oil inlet groove 357 may assist the oil to enter the inner space 351 of the cylinder portion 350. The role of the oil inlet groove 357 will be described later with reference to the drawing.

In some implementations, referring to FIG. 7, a height of the stopper 370 may be equal to or higher than that of the noise chamber 360. As shown in FIG. 1, since the upper shell 210 of the casing 200 constitutes a curved surface, if the height of the stopper 370 is equal to or higher than the height of the noise chamber 360, the stopper 370 may protect the inner components from deformation of the upper shell 210, which is caused by external impact. For example, the stopper 370 may include one or more protrusions that protrude from an outer surface of the second support 330 and that may limit contact between parts of the cylinder block 300 and the casing 200 in response to external impact.

In some examples, referring to FIG. 7, the first support 320 may have a height similar to or lower than the height of the stopper 370 and/or the noise chamber 360.

The first support 320 may be formed with a height to allow the oil to enter the cylinder portion 350 without being scattered to the outside while reinforcing rigidity enough for the shaft support 310.

The height of the first support 320 may extend to the lower side of the second support 330. Therefore, the shaft support 310 may support the rotary shaft 113 with sufficient rigidity.

The second support 330 may be provided with a groove portion 332 formed at a portion far away from the cylinder portion 350. The groove portion 332 may provide a space to which a peripheral component may be coupled.

For example, the groove portion 332 may provide a space so as not to generate interference with a terminal of a power unit (not shown).

Figure 8:
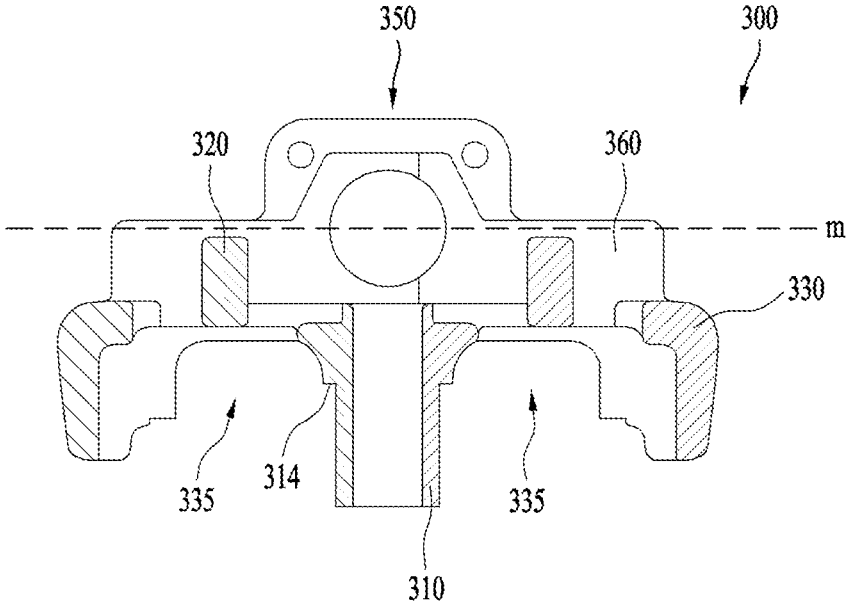
FIG. 8 is a sectional view showing the cylinder block viewed in line D-D' of FIG. 2.
Figure 9:
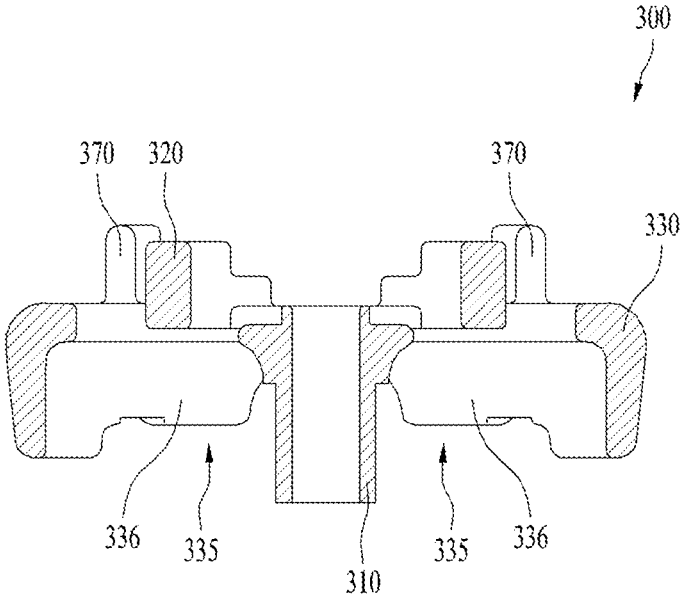
FIG. 9 is a sectional view showing the cylinder block viewed in line E-E' of FIG. 2.

FIG. 8 is a sectional view viewed in a line D-D' of FIG. 2. FIG. 9 is a sectional view viewed in a line E-E' of FIG. 2.

Referring to FIG. 8, a space 335 in which the motor 120 may be provided may be formed by the second support 330 between the shaft support 310 and the second support 330.

The shaft support 310 may extend to the lower side to support the rotary shaft 113, and the motor 120 may be provided at the portion where the shaft support 310 is extended. In some examples, a protrusion 314 for restricting a position where the motor 120 is provided may be formed.

In some examples, the first support 320 may be formed to be higher than the second support 330. As shown, the first support 320 may be formed with a height width narrower than that of the second support 330.

In some implementations, it is noted that the first support 320 may be formed with a height 'm' corresponding to a half of the cylindrical inner space 351. As described above, the first support 320 may assist the oil to enter the cylinder portion 350.

Referring to FIG. 9, a relative position of the stopper 370 may be identified together with relative heights and thicknesses of the first support 320, the second support 330 and the shaft support 310. That is, the stopper 370 may be formed at a position higher than the first support 320.

In some examples, the second support 330 may include a skirt portion 336 surrounding the motor 120. In this way, the skirt portion 336 of the second support 330 may form the space 335 for holding the motor 120 as described above.

Figure 10:
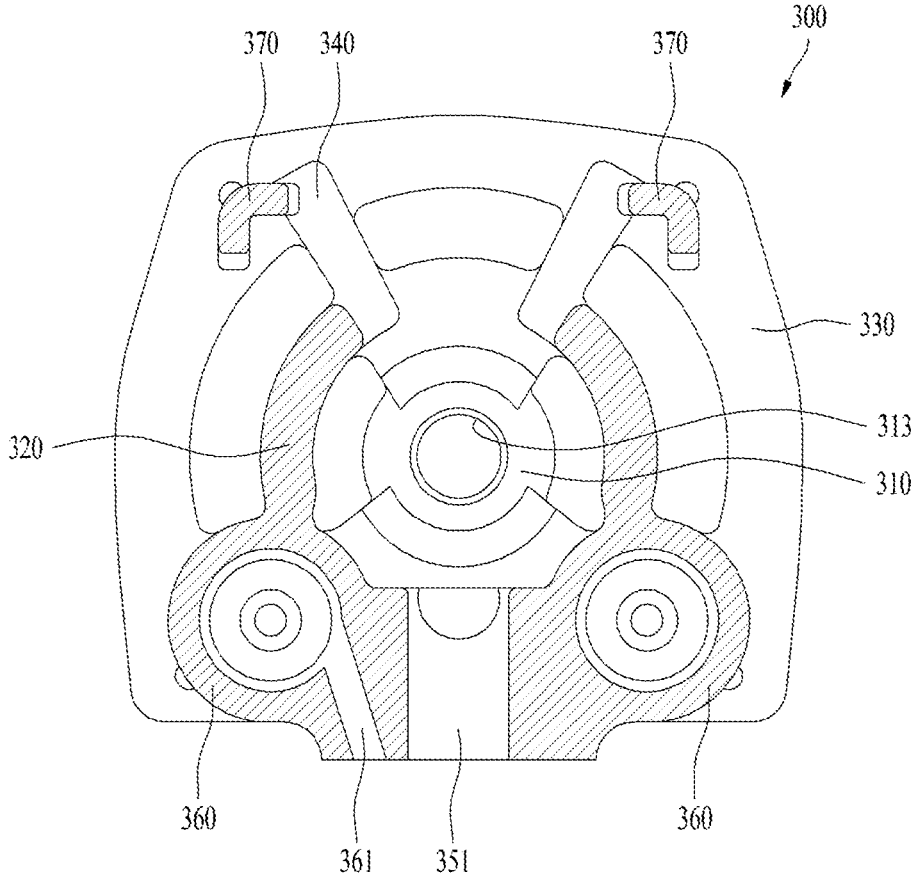
FIG. 10 is a sectional view showing the cylinder block viewed in line F-F' of FIG. 6.
Figure 11:
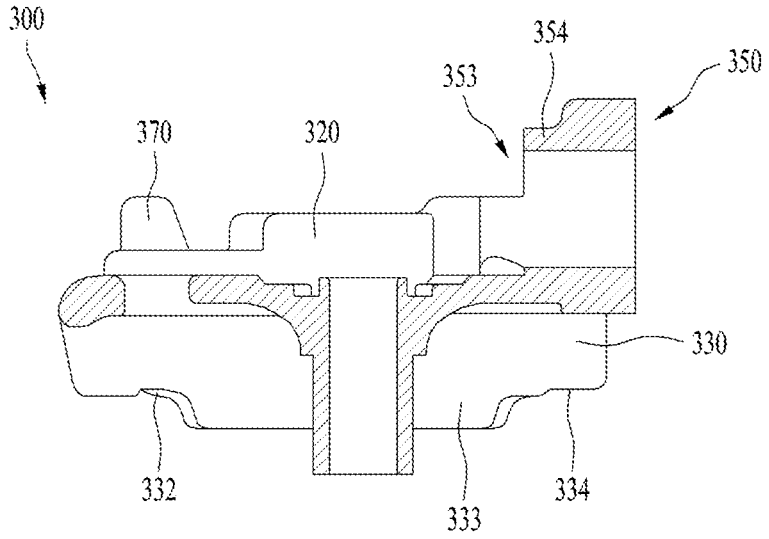
FIG. 11 is a side sectional view illustrating a cylinder block.

FIG. 10 is a sectional view viewed in a line F-F' of FIG. 6. FIG. 11 is a side sectional view illustrating a cylinder block.

Referring to FIG. 10, the noise chamber 360 and the first support 320 may be connected with each other. In this way, the noise chamber 360 is arranged at both sides based on the inner space 351 of the cylinder portion 350, and the first support 320 may be connected to the noise chamber 360. In some cases, since the first support 320 provides a structure for supporting the shaft support 310 at the outside, the first support 320 may stably support the rotary shaft 113.

Also, the first support 320 formed to be connected to the noise chamber 360 may provide a structure that can effectively counterbalance a vertical moment Mz (see FIG. 1) in the case that the outer rotor type motor 120 is provided.

In some implementations, a passage 361 connected with the space (not shown) where the compressed fluid is temporarily collected may be formed in the noise chamber 360 at one side, and the space is located in the aforementioned cylinder cover 355.

That is, the fluid compressed by the piston 116 may temporarily be collected in the space formed in the cylinder cover 355 and then enter the noise chamber 360 through the passage 361.

In some examples, the fluid entering the noise chamber 360 at one side may move to the noise chamber 360 at the other side through a pipe 180, and then may be discharged to the outside.

FIG. 11 illustrates a shape almost the same as the shape of the cylinder block 300 shown in FIG. 1. Referring to FIG. 11, the shaft support 310 may be connected to the cylinder portion 350.

Figure 12:
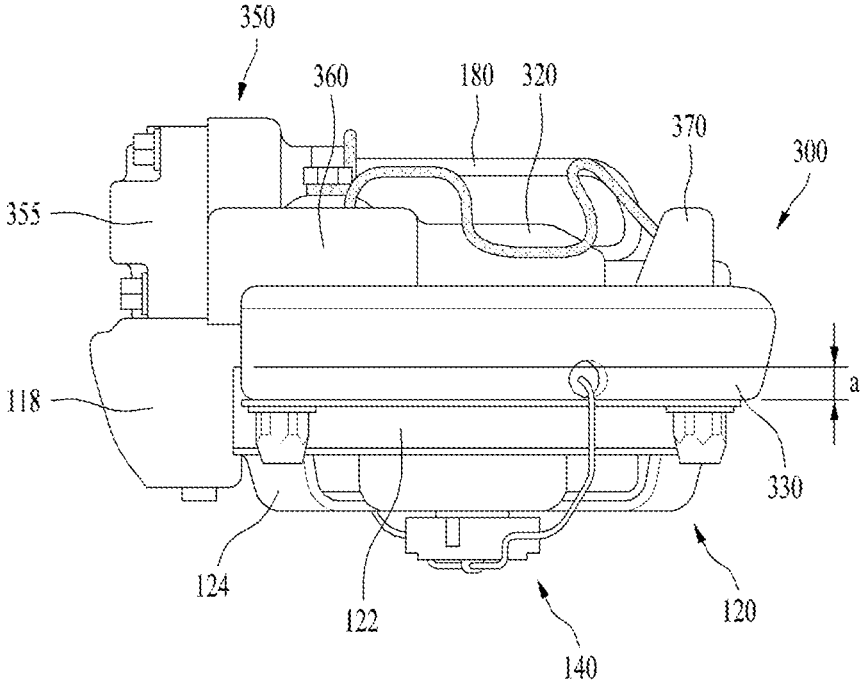
FIG. 12 is a side view illustrating an example of a compressor.

FIG. 12 is a side view illustrating a compressor.

Mass distribution of the first support 320 and the second support 330 may be performed in view of rigidity reinforcement of the compressor.

Referring to FIG. 12, the second support 330 may be formed to partially surround the rotor 122 of the motor 120. FIG. 12 illustrates that the second support 330 covers the rotor 122 as much as a certain width 'a'.

The certain width 'a' may be a half or less of a whole width (height) of the rotor 122. In this way, the second support 330 covering the rotor 122 of the certain width 'a' may be formed to allow the center of gravity of the cylinder block 300 not to be located too downwardly or formed so as not to block heat radiation of the motor 120 even while reinforcing rigidity of the cylinder block 300.

In some examples, the first support 320 may be formed to be high to reach the height of the noise chamber 360, thereby reinforcing an inertia moment of the cylinder block. That is, the first support 320 may reinforce rigidity of the shaft support 310 while preventing the inertia moment from decreased due to reduction of the width of the second support 330.

Figure 13:
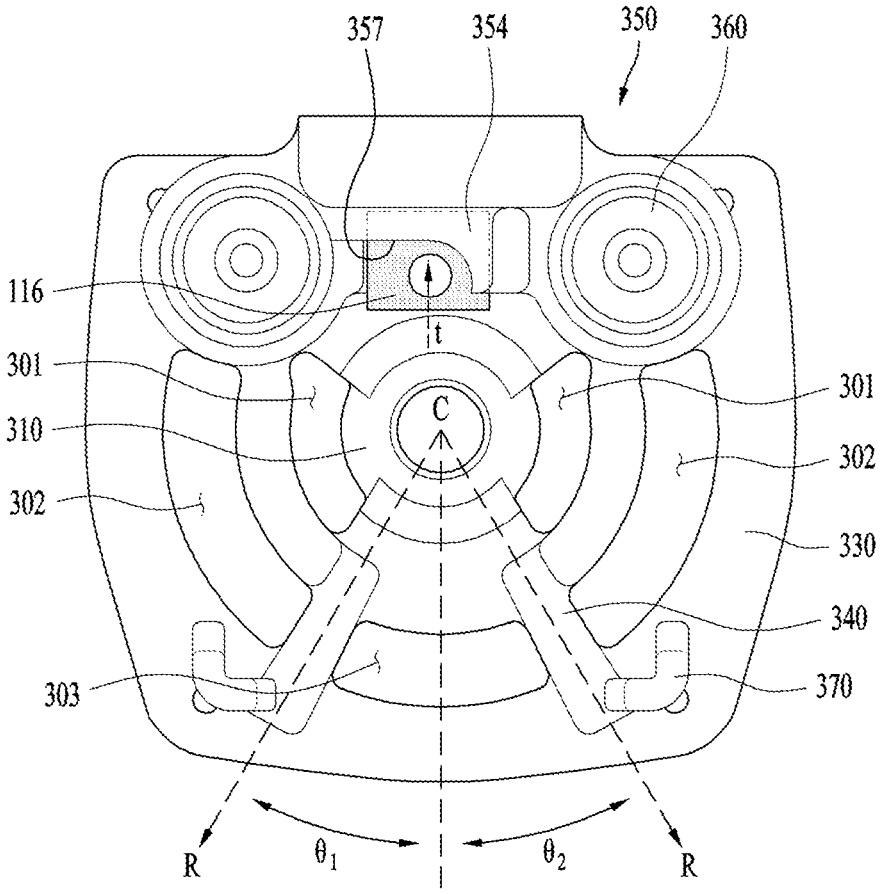
FIGS. 13 and 14 are views illustrating an example action of an oil inlet groove.
Figure 14:
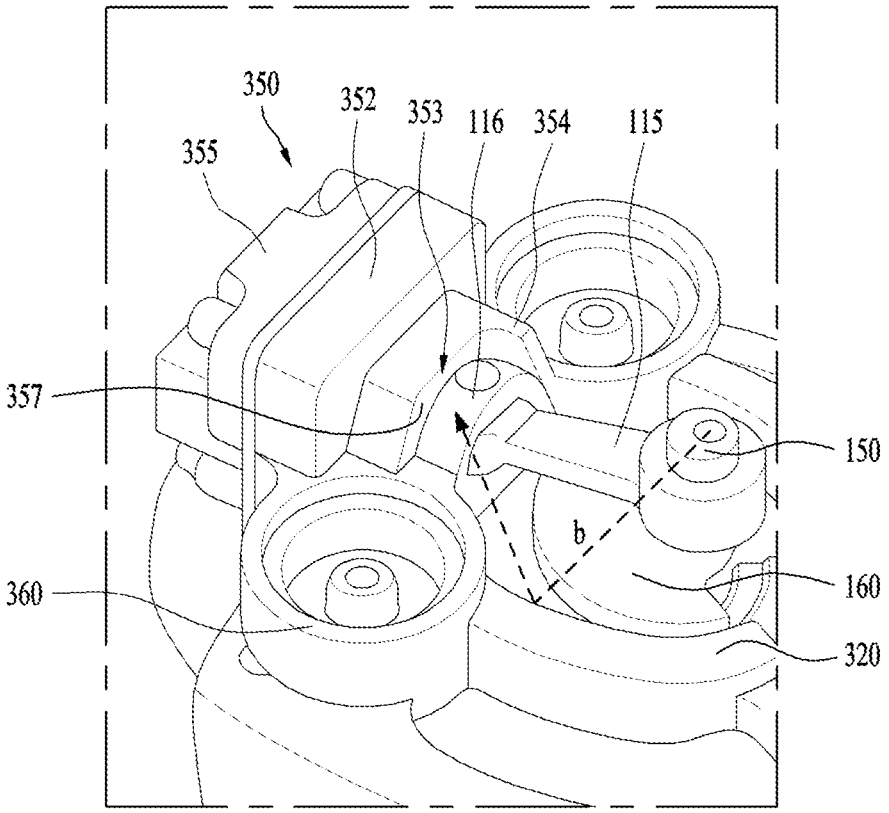

FIGS. 13 and 14 are views illustrating an example action of an oil inlet groove. In some examples, the role of rigidity reinforcement of the third support will additionally be described with reference to FIG. 13.

Referring to FIG. 13, the state that the piston 116 is located at a bottom dead point is additionally shown on the cylinder block 300.

As shown in FIG. 13, where the piston 116 is located at the bottom dead point, a large portion of the piston 116 may be exposed by the oil inlet groove 357. Therefore, the oil entering along a direction 't' may enter the inner space of the cylinder portion 350 through the oil inlet groove 357.

That is, the oil scattered from the rotary shaft 113 in the direction T reaches the piston 116 exposed through the oil inlet groove 357. In some examples, the oil may effectively enter the inner space of the cylinder portion 350 based on movement of the piston 116 to a top dead point.

In some implementations, referring to FIG. 14, the oil may be discharged from the rotary shaft 113 to another direction not the direction of the cylinder portion 350, for example, the oil may be discharged to a direction 'b'. Alternatively, the oil may be discharged to an opposite direction of the direction 'b'.

In some examples, the oil discharged to the direction 'b' reaches the first support 320 and then its direction is switched, whereby the oil may be scattered toward the cylinder portion 350. Afterwards, the movement of the oil is as described above.

Referring to FIG. 13 again, as described above, it is beneficial that angles θ1 and θ2 of the third support 340 are arranged within a certain angle from the movement direction of the piston 116.

That is, in view of rigidity reinforcement of the cylinder block 300, the angles θ1 and θ2 of the third support 340 are, for example, within 45°. In this way, if the third support 340 is located at two places, the two third supports 340 may be formed within 45° from the movement direction of the piston 116.

In some examples, the third support 340 may additionally reinforce rigidity while forming the first hole 301, the second hole 302 and the third hole 303 by connecting the first support 320 and the second support 330, as described above.

When experiment evaluation is actually carried out, it is noted that tilting of the shaft support 310 is generated at 0.0020° if the third support 340 is formed at an angle of 50° from the movement direction of the piston 116. In some examples, it is noted that concentricity is 11 μm and orthogonal deformation of the cylinder block may be generated at 0.0020°.

In some examples, tilting of the shaft support 310 is generated at 0.0012°, where the third support 340 is formed at an angle of 30° from the movement direction of the piston 116. In some examples, concentricity is 8 μm and orthogonal deformation of the cylinder block may be generated at 0.0012°.

In this way, in view of rigidity reinforcement of the cylinder block 300, the angles θ1 and θ2 of the third support 340 may be, for example, 45° from the arrangement of the first support 320 and the second support 330. In some examples, the third support 340 may have sufficient rigidity even at an angle smaller than 45°.

In some implementations, in the compressor including an outer rotor type motor, mass distribution of the cylinder block may be concentrated on the outside, whereby inertia moment may be reinforced and therefore vibration may be improved.

In some implementations, in the compressor including an outer rotor type motor, the cylinder block may reinforce rigidity while having a structurally lightweight shape.

In some implementations, in the compressor including an outer rotor type motor, heat radiation characteristic may be improved using the shape of the cylinder block that may use a heat radiation function according to the oil.

It will be apparent to those skilled in the art that the present disclosure may be embodied in other specific forms without departing from the spirit and essential characteristics of the disclosure. Thus, the above implementations are to be considered in all respects as illustrative and not restrictive. The scope of the disclosure should be determined by reasonable interpretation of the appended claims and all changes which come within the equivalent scope of the disclosure are included in the scope of the disclosure.

What is claimed is:

1. A cylinder block for a compressor, the compressor including an outer rotor type motor and a rotary shaft coupled to the outer rotor type motor, the cylinder block comprising:

a shaft support configured to support the rotary shaft;

a first support that is arranged radially outward of the shaft support and that extends along a circumferential direction about a center of the shaft support;

a second support that is arranged radially outward of the first support and that extends along the circumferential direction about the center of the shaft support;

a third support that connects the first support to the second support;

a cylinder portion that defines a cylindrical inner space at a position radially away from the center of the shaft support; and a noise chamber defined at at least one side of the cylinder portion, wherein the cylinder block defines a first hole between the shaft support and the first support, the first hole extending along the circumferential direction.

2. The cylinder block of claim 1, wherein the cylinder block further defines a second hole between the first support and the second support.

3. The cylinder block of claim 1, wherein the third support extends along a radius direction with respect to the center of the shaft support.

4. The cylinder block of claim 1, wherein the noise chamber is defined at both sides of the cylinder portion.

5. The cylinder block of claim 1, wherein the cylinder portion comprises:

a main block that defines an inner side of the cylindrical inner space; and an inlet portion connected to the main block, wherein the cylindrical inner space extends from the main block to the inlet portion toward the shaft support.

6. The cylinder block of claim 5, wherein the inlet portion defines an oil inlet groove having an open side.

7. The cylinder block of claim 1, further comprising a stopper that protrudes from the second support and that is configured to limit contact between parts of the cylinder block and a casing of the compressor in response to external impact.

8. The cylinder block of claim 7, wherein the stopper is connected to the third support.

9. The cylinder block of claim 1, wherein the first support connects between the noise chamber and the third support.

10. A compressor comprising:

a casing that defines a sealed inside space therein;

a cylinder block located in the sealed inside space;

a motor disposed in the sealed inside space at a position vertically below the cylinder block, the motor being an outer rotor type motor;

a rotary shaft coupled to the cylinder block, the rotary shaft comprising an eccentric portion that is disposed at a position offset from a center of the rotary shaft and that is configured to be rotated by a rotational force of the motor; and a piston connected to the rotary shaft and configured to reciprocate within the cylinder block based on rotation of the eccentric portion, wherein the cylinder block comprises:

a shaft support coupled to the rotary shaft and configured to support the rotary shaft, a first support that is arranged radially outward of the shaft support and that extends along a circumferential direction about a center of the shaft support, a second support that is arranged radially outward of the first support and that extends along the circumferential direction about the center of the shaft support, the second support surrounding at least a portion of an outer rotor of the motor, a third support that connects the first support to the second support, a cylinder portion that defines a cylindrical inner space configured to receive the piston, and a noise chamber defined at at least one side of the cylinder portion.

11. The compressor of claim 10, wherein the cylinder block defines a first hole between the shaft support and the first support.

12. The compressor of claim 11, wherein the cylinder block defines a second hole between the first support and the second support.

13. The compressor of claim 10, wherein the third support extends along a radius direction with respect to the center of the shaft support.

14. The compressor of claim 10, wherein the noise chamber is defined at both sides of the cylinder portion.

15. The compressor of claim 10, wherein the cylinder portion comprises:

a main block that defines an inner side of the cylindrical inner space; and an inlet portion connected to the main block, and wherein the cylindrical inner space extends from the main block to the inlet portion toward the shaft support.

16. The compressor of claim 15, wherein the inlet portion defines an oil inlet groove having an open side.

17. The compressor of claim 10, further comprising a stopper that protrudes from the second support and that is configured to limit parts of the cylinder block and the casing in response to external impact.

18. The compressor of claim 17, wherein the stopper is connected to the third support.

19. The compressor of claim 10, wherein the first support connects between the noise chamber and the third support.

* * * * *